United States Patent [19]

Rivers

[11] 4,026,784

[45] May 31, 1977

[54] METAL RECOVERY UNIT

[76] Inventor: James R. Rivers, Rte. 1, Coalfield, Tenn. 37840

[22] Filed: Nov. 10, 1975

[21] Appl. No.: 630,442

[52] U.S. Cl. ..... 204/273; 204/237; 204/272

[51] Int. Cl.[2] ..... C25C 1/22; C25C 1/00

[58] Field of Search ..... 204/272, 275, 276, 273, 204/237

[56] References Cited

UNITED STATES PATENTS

| | | | |
|---|---|---|---|
| 2,997,438 | 8/1961 | James et al. | 204/276 |
| 3,003,942 | 10/1961 | Cedrone | 204/276 |
| 3,061,537 | 10/1962 | Yagishita | 204/275 |
| 3,694,341 | 9/1972 | Luck, Jr. | 204/272 |
| 3,728,244 | 4/1973 | Cooley | 204/275 |
| 3,871,989 | 3/1975 | King | 204/272 |

*Primary Examiner*—T. M. Tufarielio
*Attorney, Agent, or Firm*—Fitch, Even, Tabin & Luedeka

[57] ABSTRACT

An improved metal recovery unit for recovering metal from metal-laden liquids by electrolysis. The metal recovery unit comprises container means including a tubular cathode defining an upright substantially cylindrical wall having a top end closed by cover means and a bottom end closed by base means. In one embodiment, metal-laden liquid is introduced into the container means through a first opening in the cover means disposed generally adjacent the anode. Metal-depleted fluid is withdrawn from the container means through a further opening in the cover means at a location spaced apart from the first opening. An elongated anode is concentrically disposed within the cathode. The liquid within the container is recirculated by continually withdrawing a portion thereof from a passageway in the base means and reintroducing such fluid into the container means through an inlet passage in the cover means tangentially and angularly downward with respect to the cathode wall to develop a generally downwardly helical flow path of liquid adjacent the cathode. Control means provides at least first and second current densities at the cathode for depositing metal on the cathode at a reduced rate as metal is depleted from the recirculated fluid.

8 Claims, 5 Drawing Figures

METAL RECOVERY UNIT

This invention relates to a metal recovery unit for recovering metal from metal-laden liquids and more particularly concerns such a unit adapted to enhance the quality and increase the quantity of the metal recovered.

In general, electrolytic metal recovery units include a current source connected to an anode and a cathode disposed in metal-laden liquid. Current flowing between these electrodes passes through the metal-laden liquid causing metal in the liquid to be deposited on the cathode at a rate dependent upon the cathode current density, among other things.

Electrolytic metal recovery units are particularly suited for recovering silver from photographic fixing solutions (at times referred to as "hypo" ) used in removing undeveloped silver halides from film emulsion. Conventionally, the fixing solution is conveyed from a film processor into the metal recovery unit where the silver in electrolytically deposite on a cathode. as the concentration of the silver in the solution is reduced, the fixing solution is rejuvenated and may be used in the further development of film.

Heretofore, it has been recognized that the fixing solution detriorates and the quality of the recovered silver is reduced unless the metal-laden liquid is agitated during the recovery process. It has also been recognized that the rate of the silver withdrawal and the quality of the silver recovered are related to the current density at the cathode. If the current density is too high a silver sulfide is formed thereby ruining the fixing solution and substantially reducing the then value of the silver recovered. Exposure of the metal-laden fluid to the cathode where th silver ions can be deposited has also been suggested heretofore as being beneficial to rapid and complete recovery of the silver.

It is therefore an object of the invention to provide an improved metal recovery unit for recovering metal from a metal-laden solution. It is another object of the invention to provide a metal recovery unit which recirculates the metal-laden fluid through a cylindrical cathode means along a generally downward helical path for increasing the exposure of the liquid to the cathode. It is another object of the invention to provide a metal recovery unit including control means for generating predetermined cathode current densities to enhance the rate of metal recovery and the quality and quantity of the metal recovered. It is another object of the invention to provide a metal recovery unit useful in the recovery of silver from photographic fixing solutions including current density control means responsive to a photographic film processor of conventional design.

These and other objects of the invention will become apparent from a reading of the following specification and claims, taken together with the accompanying drawings, wherein:

Figure 1:
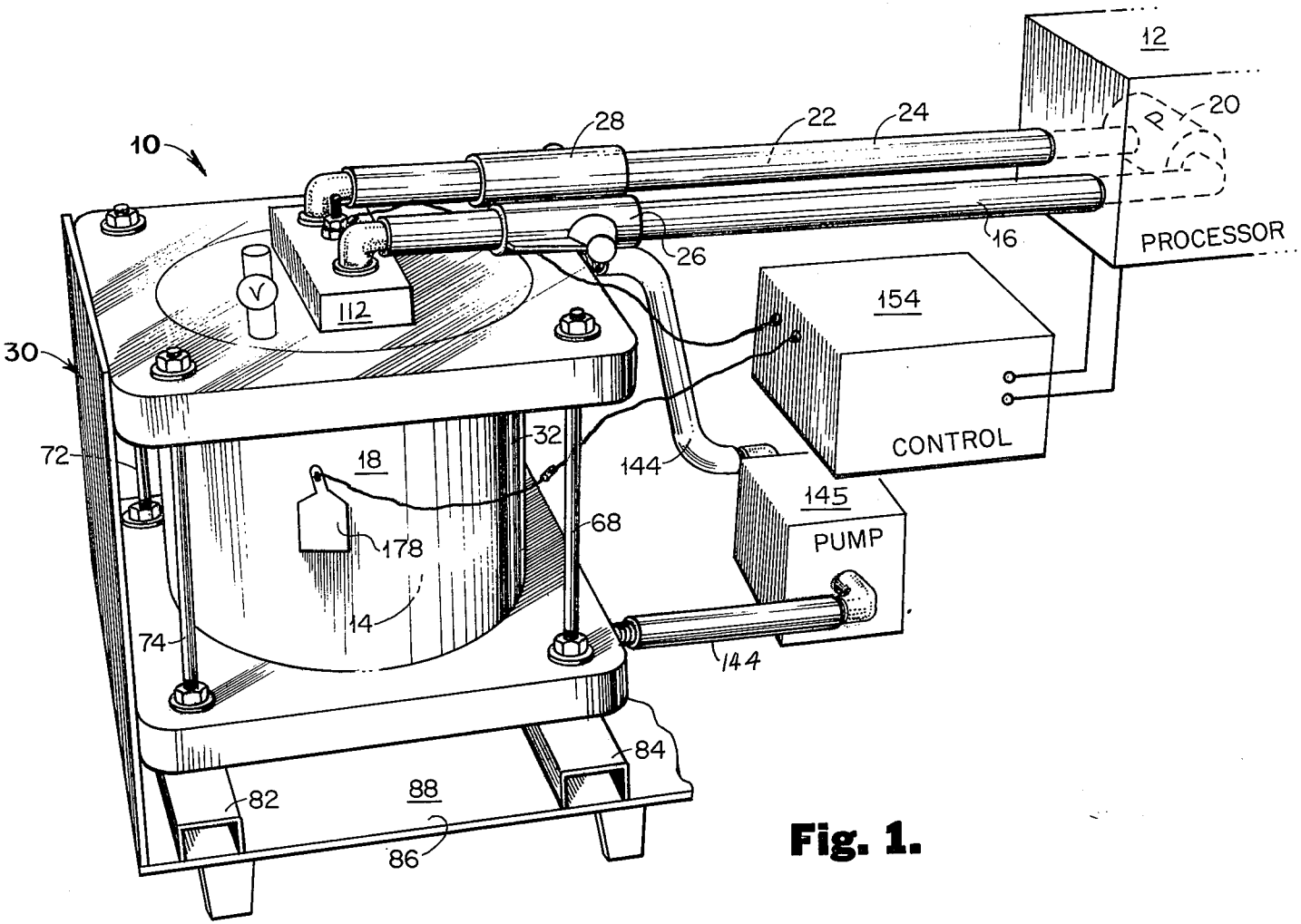
FIG. 1 is a perspective view of a metal recovery unit showing various features of the invention.

In accordance with the present disclosure there is provided an improved metal recovery unit for recovering metal from metal-laden fluids by electrolysis comprising container means including a tubular cathode defining an upright substantially cylindrical wall having its top end closed by cover means and its bottom end closed by a base means. An anode is disposed concentrically within the cathode. The base means is provided with a passage through which liquid is withdrawn by a pump means in communication therewith. The pump means further communicates with a passage in the cover means through which the liquid is reintroduced into the container means. The geometry and physical location of the passage in the cover means provides for tangential and angularly downward flow of the reintroduced liquid along a generally helical flow path adjacent the cathode wall to expose the silver in the liquid to a substantial area of the cathode for electrodeposition of the silver onto the cathode. Control means is provided for establishing a first current density at the cathode for a predetermined period of time and for establishing a second and lower current density at the cathode at other times. In one embodiment meatl-laden liquid is conveyed from a film processor to the container means and thereafter reconveyed to the film processor after having a substantial amount of silver removed therefrom.

Referring to the Figures, a metal recovery unit constructed in accordance with the present invention is indicated generally at 10. This recovery unit finds particular application when used in combination with a film processor, indicated at 12 which employs a fixing or "hypo" solution to dissolve silver halides in film emulsion. A typical processor is the Kodak X-Omat X-ray film processor Model M6AN which includes a "safe light" which is automatically switched "off" when film enters the processor. In the depicted system, fixing solution 14 is stored in the processor or reservoir means 12 from which it is fed through a conduit 16 from the processor 12 into a container means indicated generally at 18 under hydraulic pressure developed by conveying means such as a pump 20, associated with the processor. Silver in the fixing solution 14 is recovered in the recovery unit 10 and deposited on the cathode by electrolytic action. The silver-depleted solution 22 is fed back into the processor 12 through a conduit 24 for developing additional film. The conduit 16 and 24 are each provided with a valve, 26 and 28 respectively, that serves to control the flow of liquid between the processor and the recovery unit.

The illustrated metal recovery unit includes a housing, generally indicated at 30, within which various elements of the unit are mounted. A suitable cover (not shown) is secured to the housing 30 to exclude contaminants and discourage pilferage.

The depicted container means 18 includes a tubular cathode 32 fabricated from any suitable material which is electrically conductive and inert to the corrosive liquid circulated therethrough. One suitable material is Type 316 stainless steel. The tubular cathode 32 defines an upright smooth cylindrical interior wall 34 onto which the silver is electrolytically deposited.

The cathode 32 is closed at its top end 36 by removable cover means comprising a substantially retangular cover 38, in the depicted embodiment, fabricated from an inert material which is relatively inert to the anticipated corrosive liquids. One suitable material for the fabrication of the cover 38 is clear acrylic plastic which is inert to conventional photographic fixing solutions and enables viewing the interior of the container means to determine the amount of silver or other metal deposited on the cathode. The depicted cover 38 is provided with four bores 40, 42, 44, and 46 extending through the thickness thereof at its corners 48, 50, 52, and 54, and with a bore 55 disposed centrally of the cover.

To complete the closure of the container means 18 a rectangular base means 56 that is dimensionally like the cover 38 and includes bores 58, 60, 62, and 64 extending through the thickness thereof at its corners is provided across the bottom end 66 of the cathode 32. As illustrated, the cover 38 and the base 56 are removably secured to the ends of the cathode by four elongated bolts 68, 70, 72, and 74 which pass through the registered bores of the corners of the cover and base and which extend substantially parallel to the axis of the cathode on the outside thereof. Preferably, annular seal means 76 and 78 are interposed between the cathode ends and the cover and the base. Appropriate nuts 80 threadably received on the bolts removably secure the cover, base and seals to the cathode ends.

The base 56 of the container 18 is mounted on parallel spaced apart elongated supports 82 and 84 which extend from the forward margin 86 of the housing base 88 to the rear margin of the housing base in the illustrated embodiment. These supports 82 and 84 maintain the base 56 of the container means spaced apart vertically from the base 88 of the housing such that a wrench can be inserted into this spaced region for threadably disengaging the base 56 and the cathode 32.

An elongated anode 90 fabricated from an electrically conductive material such as titanium coated with a thickness of about 150 microinches of platinum which is not corroded by exposure to the fixing solution within the container means 18 is concentrically disposed with the cathode 32. The illustrated anode 90 is generally cylindrical and preferably includes rounded opposite end portions 92 and 94. The lower end 92 of the anode is vertically spaced above from the base 56 such that liquid will flow therebetween. The anode is provided at its upper end 94 with a threaded stem 96 that is received through a central bore 55 in the cover. The upper end portion 100 of this threaded stem 96 projects above the cover and recieves a first nut 102 for securing the anode 90 into position. An electrical connector 104 is interposed between the first nut 102 and a second nut 106 to connect the anode, through an appropriate electrical lead, to a power source as will be further discussed hereinafter.

As seen in FIG. 1, the cover is further provided with a liquid inlet means 108 which comprises a bore spaces apart radially from the central bore 55 in the depicted embodiment. The conduit 16 leading from the processor pump is connected in liquid flow communication with this inlet means 108 so that metal-laden liquid pumped by the processor pump 12 enters the container means 18 through such inlet 108. Notably, the liquid inlet 108 is disposed adjacent to and above the anode 90 so that liquid entering the container means 18 flows generally downward over the top end 94 of the anode 90.

Still further, the cover includes a liquid outlet means 110 comprising a bore located diametrically opposite the inlet means 108 on the opposite side of the central bore 55. The return conduit 24 connected to the processor pump is connected to the outlet means 110 for conveying metal-depleted liquid from the container to the processor 12.

A mounting block 112 is secured adjacent the top surface 114 of the cover 38 by the bolt extending through the central bore 55. Spaced apart bores 116 and 118 in the mounting block register with the inlet 108 and outlet 110 and communicate at their opposite ends 120 and 122 with the conduits 120 and 122, respectively to provide a connection between these conduits and the inlet 108 and outlet 110 respectively.

Figure 2:
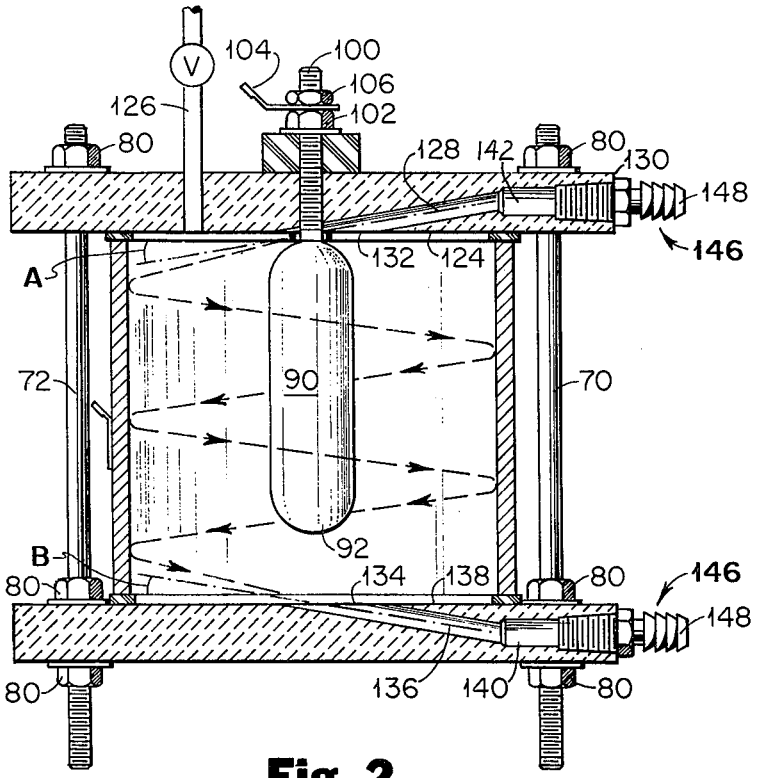
FIG. 2 is a sectional view of a container means useful in the metal recovery unit shown in FIG. 1.
Figure 4:
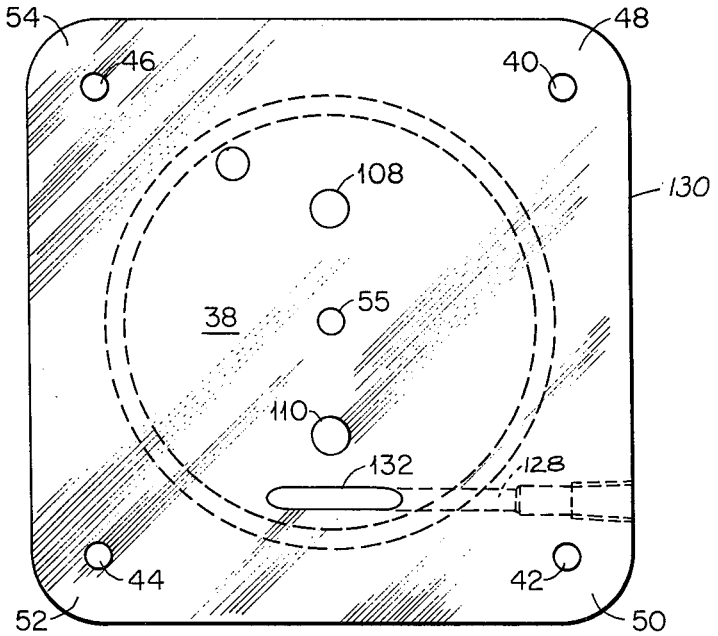
FIG. 4 is a plan view of cover means for the container means shown in FIG. 2.
Figure 3:
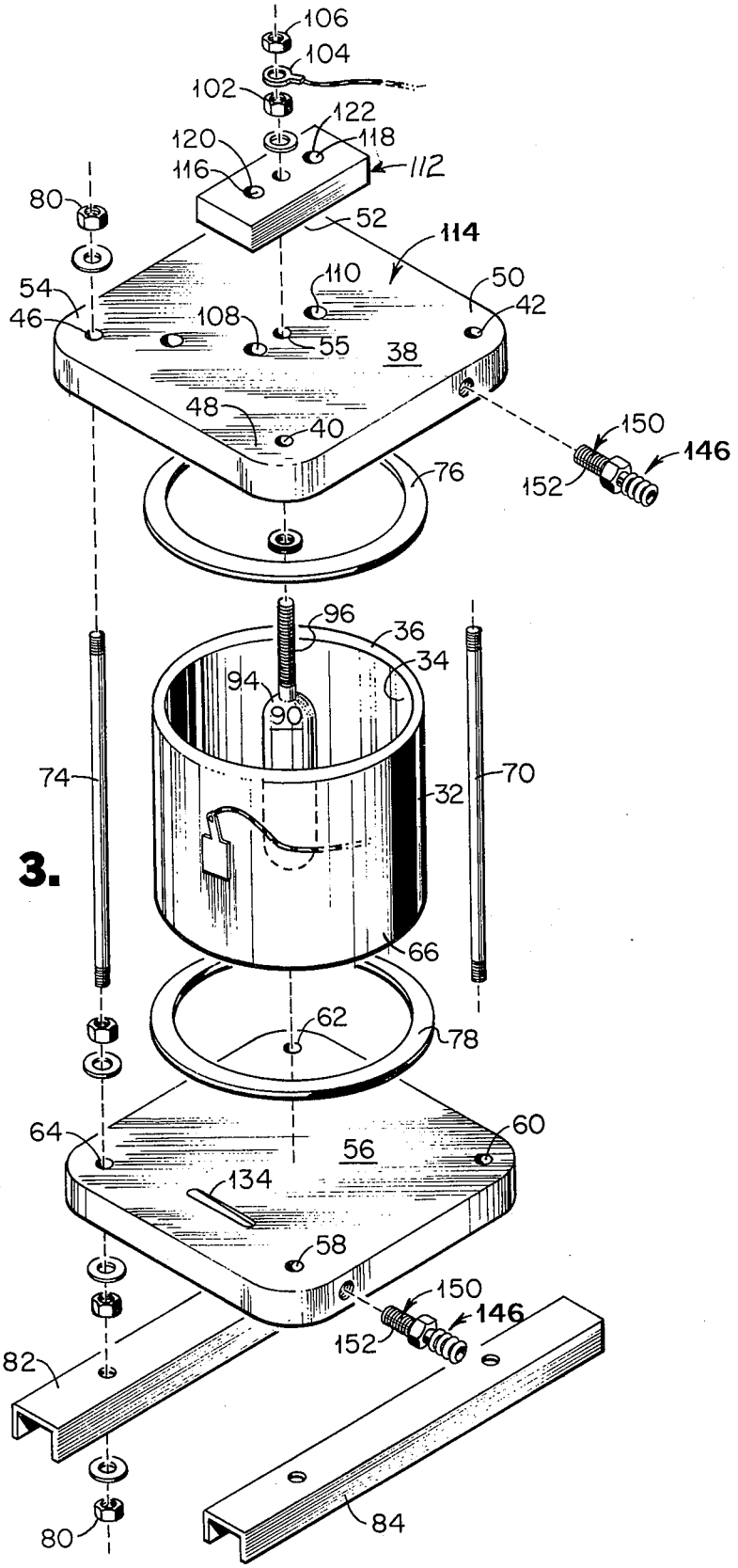
FIG. 3 is an exploded view of the container means.

The container means 18 is maintained at full volume during metal recovery processing so that the upper surface of the liquid contained with the container contacts the lower surface 124 of the cover 38 enabling liquid to be admitted to and withdrawn from the container by way of the inlet 108 and outlet 110. A check valve-controlled vent 126 is mounted in the cover and communicates with interior of the container means 18 as shown in FIG. 2, to prevent gases, which may enter the container means with metal-laden fluids pumped from the processor, or which may be otherwise generated within the container, from building up pressure within the container means.

It has been found that the rate of metal withdrawal from the liquid in the container is enhacced by increasing the exposure of the liquid to the cathode surface through the means of a liquid flow path that moves the liquid in a downward helical path that substantially follows the curvature of the inner cylindrical wall of the cathode. This is accomplished by withdrawing liquid from the bottom of the container and reintroducing the withdrawn liquid into the container at the top thereof. Importantly, the outlet through which the liquid is withdrawn is of a nature and so located as minimizes disturbance of the liquid flow path within the container and the nature and location of the inlet through which the liquid is reintroduced into the container is such that there is established the preferred helical flow of the liquid along the cathode wall.

In the illustrated embodiment, the liquid flow path within the container 18 is established by reintroducing liquid into the container 18 in the form of a jetting stream through an elongated recirculating inlet passage 128 under pressure that leads from one side edge 130 of the cover 38 through a portion of the cover to an inlet port 132 located laterally of the anode 90 and adjacent the inner wall 34 of the cathode 32. The axis of the recirculating inlet passage 128 defined by the cover 38 is directed generally tangential to the cylindrical cathode wall 34 but is displaced inwardly thereof toward the anode 90 by a distance sufficient to provide for the build-up of a layer of metal on the cathode wall without the incoming liquid impinging on the accummulated layer such as disrupts the desired downward helical flow path of the liquid.

As noted, the liquid enters the container as a pressurized stream. The axis of the passage 128 is oriented at a downward angle to establish the pitch of the helical flow path followed by the liquid as it moves past the cathode wall. In one embodiment, this angle A is chosen to be an acute angle of about nine degrees defined between the axis of the inlet passage and the bottom surface 124 of the cover 38 as shown in FIG. 2. Depending upon the internal diameter of the cathode 32 and its vertical height, the entry angle is preferable chosen such that liquid will circle the cathode circumference at least about two and one-half times between the inlet port 132 and the outlet port 135 in the base 56. This provides for good exposure of the liquid to the cathode wall 34 for metal withdrawal at a suitable rate while not permitting any portion of the liquid to remain exposed to the cathode for a time sufficient for the liquid to be depleted of its metal (silver) content to the extent that sulfiding occurs.

The circulating liquid is withdrawn from the container 18 through the outlet port 134 of a recirculating outlet passage 136 defined in the base 56 at a rate substantially equal to the rate of introduction of liquid through the inlet port 132 so that there is a constant flow of liquid through the container. The outlet port 134 in the base 56 preferably is located diametrically opposite the inlet port 132 in the cover 38 and with the axis of the recirculating outlet passage 136 oriented with the helical angle of the liquid path, hence defining an acute angle B with the top surface 138 of the base of equal value to the angle A defined by the axis of the inlet passage 128 so that the liquid is moving toward the exit port for withdrawal therethrough. The outlet port 134 preferably is of the same geometry and size as the inlet port 132 so that it is a mirror image of the inlet port but is located on the diametrally opposite side of the anode 90 as the inlet port 132.

The outboard end 140 of the recirculating outlet passage 136 is connected in liquid communication with the outboard end 142 of the inlet passage 128 by a conduit 144 having a pump means 145 interposed therein along its length by means of which the liquid is withdrawn from the container 18 through the outlet passage 136 and reintroduced under pressure through the inlet passage 128 into the container.

In the illustrated embodiment, each of the inlet and outlet passages are provided with fitting means 146 adapted to be threadably received in a respective passage to provide a connection between the passage and an end of the conduit 144. Each of the illustrated fittings includes a tubular nozzle portion 148 having external corrogations and proportioned for insertion into the end of the conduit 144 with the corrogations forming a seal against the escape of liquid from between the nozzle and the conduit. Each fitting further includes a tubular base portion 150 provided with an outer wall 52 which is externally threaded and adapted to be threadable received in the internally threaded outboard end of the respective passage.

From the foregoing, it will be recognized that metal-laden liquid is withdrawn from the container means 18 through the recirculating outlet passage 136 by the pump 145. The fluid is then passes through the pump 145 and reintroduced through the inlet passage 128 into the container 18.

Control means are provided to establish a relatively high current density at the cathode 32 which affects a relatively rapid metal recovery rate for a predetermined period during which time there is a high concentration of metal contained in the liquid circulated through the container means. At the end of this period, an idler current density is established to substantially reduce the recovery rate of the metal from the circulated liquid.

In recovering silver from fixing solutions, deposition of silver onto the cathode 32 preferably occurs at a maximum rate so long as there is sufficient silver in the solution to prevent sulfiding. Additionally, even though there is a relatively small amount of silver in the solution, it is desired that such smaller amounts be recovered, again without sulfiding. The present inventor accomplishes these objectives through the means of a control that establishes a first and relatively large cathode current density for a preselected period of time that is determined empirically for a given set of circumstances. At all other times, the control establishes a second and relatively low cathode current density that results in the deposition of silver onto the cathode at a rate such that sulfiding will not occur before additional silver-laden solution is introduced into the container. In one common situation, it is desired to recover the silver from the fixing solution of an X-ray film processor. In this type operation, the exposed film is fed into the processor and automatically passed therethrough for developing. Thus the processor may run continuously if there is sufficient film to be processed, or it may run intermittently. Commonly therefore, such processors are held "safe" or "ready" to receive a film but are inoperative until a film is introduced therein.

The illustrated control means 154 comprises a timer 156 which is switched between operating modes in response to an input signal transmitted from the processor 12, such as the single (or absence of a signal) that commences the operation of the processor upon the introduction of a film therein, to the timer 156 along 158 and 160. In one embodiment, these leads 158 and 160 are connected to the electrodes (not shown) of a "safe light" on the processor 12 which goes off when film enters the processor 12 to be developed.

A transformer 162 includes a primary winding 164 and a secondary winding 166 which is connected by leads 168 and 170 through a rectifier 172 to positive and negative electrodes 174 and 176 which are respectively connected to the anode connector 104 and the cathode connector 178. The rectifier 172 comprises a single diode 180 in the illustrated embodiment, however, a full wave rectifier or other conventional means for rectifying the AC output signal of the transformer 162 may be used as desired. This rectifier converts the AC signal at the output of the transformer into a DC signal which is applied to the cathode 32 and anode 90 through the electrical connectors 178 and 104, respectively.

Figure 5:
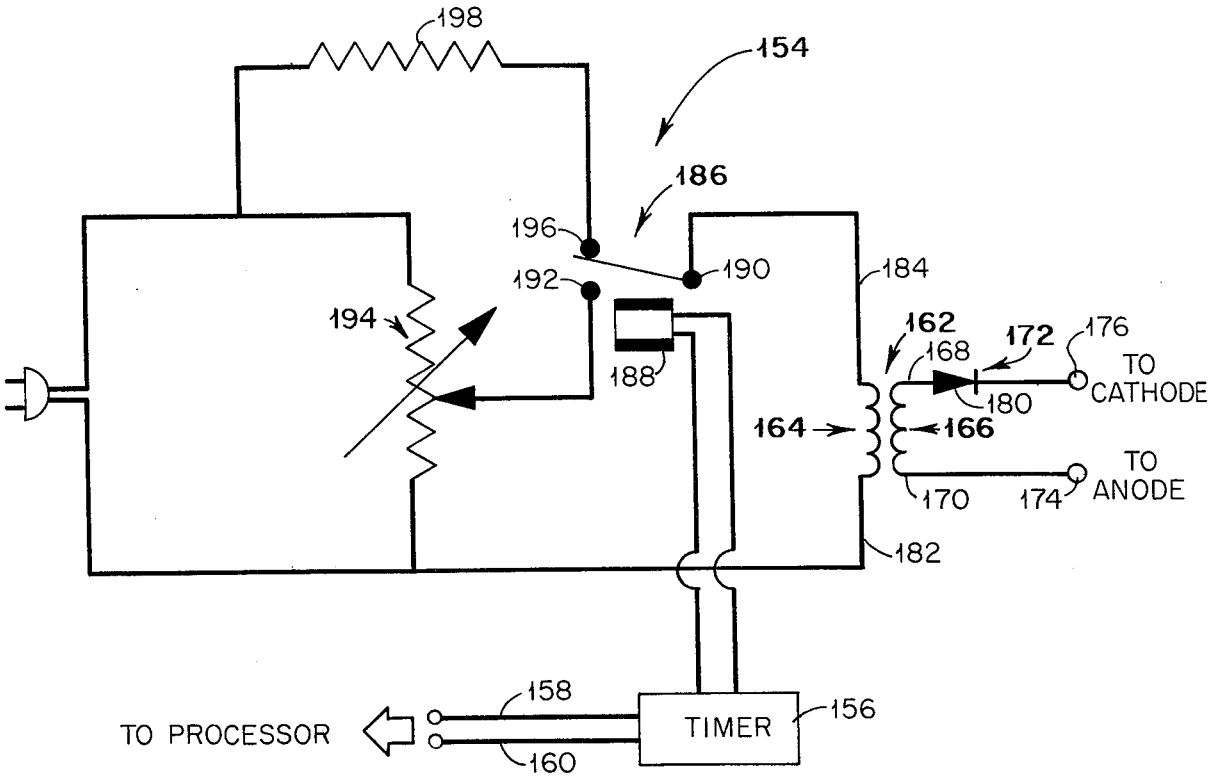
FIG. 5 is a schematic drawing of control means for the metal recovery unit of FIG. 1.

The leads 182 and 184 of the primary winding 164 of the transformer 162 are connected through a switching circuit 186 to a conventional 155 volt outlet. This switching circuit 186 is operable between a first and second mode in the illustrated embodiment by a relay 188 controlled by the timer 156. The first mode, is entered in the illustrated embodiment when the "safe light" is switched off, and the timer 156 actuates the relay 188 to connect terminal 190 with terminal 192 for a predetermined period. As shown in FIG. 5, when terminal 192 of the switching circuit is connected to terminal 190, the transformer 162 is connected in the parallel with a rheostat 194 and a normal operating current density is applied to the cathode for rapid removal of the metal from the liquid recirculated through the container means. This connection is maintained during the period between switching the "safe light" off and the timing interval as set on the timer 156 which may be varied within the limits imposed by the timer. One typical interval is approximately 6 minutes. At the end of this period, the timer 156 actuates the relay 188 so that terminal 190 and terminal 196 are connected, thereby connecting the resistor 198 in series with the transformer 162 to establish an idler current density at the cathode 32.

In one specific embodiment, the cathode was fabricated from seamless stainless steel tubing 5⅞ inches long having an internal diameter of 6.065 inches and an outside diameter of 6.625 inches. The cover and base were fabricateed from a 10 × 10 plate of clear acrylic plastic and mounted at opposite ends of the cathode by four elongated bolts extending through registering bores at four corners of the base and cover disposed outwardly of the outer surface of the cathode. The anode was fabricated from titanium coated with platinum. The cylindrical portion of the anode had a diameter of 1½ inches and the rounded opposite end portions of the anode had a sherical radius of ¾ inches. A 2¼ inch long bolt was integrally formed with the upper rounded end 94 and extended through the bore 98 centrally located in the cover 38 such that the anode was disposed concentrically with the cathode. A nut 102 was recieved by the upper end of the anode bolt 96 which extends through the cover 38. The upper end portion of the bolt was provided with an electrode interposed between the nut 102 and a second nut 106. A second electrical connection was welded to the outer surface of the cathode. The angles A and B were set at 9 degrees and 16 minutes which established a substantially downward helical liquid flow path in the counterclockwise direction within the container means as viewed from above.

The control means included a timer having a timeout interval adjustable between 0 and 6 minutes. In one embodiment, a 3.5 ampere current was applied to the anode and cathode for maximum recovery rate of the silver from an X-ray film processor. The resistor 198 was chosen to be 950 ohm and the idler current was set at 0.7 amperes. The AC voltage applied across the rectifier was set at 6.3 volts. It was found in this embodiment that by circulating the metal-laden liquid within the container along a helical path while maintaining for 6 minutes a cathode current of about 3.5 amperes and thereafter reducing the current flowing to the cathode from 3.5 amperes to 0.7 amperes, substantially all the silver was recovered at a rate substantially equal to the rate at which "new" silver was introduced into the solution in the processor. The recovered silver was of a high quality, e.g. it was relatively dense and substantially free of contaminants. Thereafter, further recirculation of the silver-depleted solution through the container while holding the cathode at 0.7 amperes resulting in the deposition of practically all the remaining silver from the solution under conditions that reduce the possibility of sulfiding.

In a typical operation employing the discolosed metal recovery unit to recover silver from a fixing solution such as is found in a conventional X-ray film processor, the disclosed unit is assembled and the electrical leads 170 and 168 connected to the anode and cathode, respectively, further the leads 158 and 160 of the control circuit are connected to the "safe" light switch on the processor. The recovery unit is activated by plugging it into a conventional electrical outlet. Upon the activation of the control circuit, the recirculation pump 145 is started and the control means establishes an EMF between the anode and cathode to provide an "idler" current density at the cathode.

The unit is filled with fixing solution from the processor, using the processor pump 20. Upon the introduction of fixer solution to the container, the recovery unit pump 145 commences recirculating the liquid within the container and the silver commences plating out of the cathode at a rate determined, at least in part, by the idler current density at the cathode.

When an exposed X-ray film is introduced into the processor for development of the film, the "safe" light circuit in the processor is deactivated. This action actuates the timer 156 in the control circuit which in turn actuates the relay 188 to switch the rheostat 194d into the control circuit to develop the desired relatively high current density at the cathode. This relatively high current density remains in effect until the timer times out. If film is continually fed into the processor, the control circuit maintains the relatively high current density at the cathode for as long as film is continued to be fed into the processor. If no further film is admitted into the processor, the timer times out in the preset time, which activates the relay 188 to switch the rheostat out of the circuit and to switch the resister 198 into the circuit to reestablish the idler current density at the cathode. Notably, the recirculation pump 146 runs continuously.

Silver metal accummulated on the cathode is removed from the recovery unit by disassemblying the unit, withdrawing the cathode and thereafter tapping the cathode on its side to break away the silver coatings thereon. It will be recognized that prior to disassemblying the unit for recovering the silver, the unit is drained of liquid as by disconnecting the conduit 144 from the outlet passage 138, and the control circuit is deenergized.

It will be recognized that the disclosed metal recovery unit is operable independently of a film processor to recover metal from other sources either on a batch or continuous basis. This is accomplished by disconnecting or closing the conduits 16 and 24 which communicate between the processor and the container. The container is thereafter filled with metal-laden liquid and the control circuit is activated to withdraw metal from the solution at a relatively high rate for a preset period of time, to remove a major portion of the silver relatively quickly. Thereafter, the circuit switches to its lower current density to withdraw substantially all the remaining metal. Because the lower current density has little or no deleterious effect upon the recirculating liquid, the unit can be started and left unattended. As desired, the control circuit is readily changed to fully deactivate the unit when the timer out, as desired.

While a preferred embodiment has been shown and described, it will be understood that there is no intention to limit the invention by such disclosure, but rather, it is intended to cover all modifications and alternate constructions falling within the spirit and scope of the invention as defined in the appended claims.

I claim:

1. A metal recovery unit for recovering metal from metal-laden liquids by electrolysis comprising:

container means including a tubular cathode open at its opposite ends and defining an upright substantially cylindrical wall of said container means, cover means secured across and closing the top end of said cathode, said cover means defining liquid inlet means through which metal-laden liquid enters said container means and liquid outlet means through which metal-depleted liquid exits said container means, said cover further defining recirculating inlet passage means, said recirculating outlet passage means communicating with the interior of said container means and disposed with respect to said cylindrical wall to introduce liquid into said container means tangentially and angularly downwardly with respect to said cathode wall whereby liquid introduced into said container means through said recirculating inlet passage means flows substantially tangentially and downwardly of said cathode, and base means secured across and closing the bottom end of said cathode, said base means defining recirculating outlet passage means communicating with the interior of said container means, said recirculating outlet passage means extending in the direction of and tangentially with respect to the flow of said metal-laden liquid adjacent said base means for withdrawing liquid from said container means, an elongated anode disposed concentrically within said cathode, means for recirculating liquid within said container means, including conduit means connecting said recirculating inlet passage means in said cover means of said container means, with said recirculating outlet passage means of said base means, and pump means interposed in said conduit means along the length thereof, control means developing a first current density at said cathode for electrolytically depositing metal from metal-laden liquid relatively rapidly onto said cathode for a predetermined period of time, and thereafter developing a second current density at said cathode.

2. The metal recovery unit of claim 1 and including reservoir means disposed externally of said container means for containing metal-laden liquid to be processed by said metal recovery unit, means for conveying said metal-laden liquid from said reservoir means through said inlet means disposed in said cover means into said container means and for conveying processed liquid from said container means through said outlet means disposed in said cover means to said reservoir means,

3. The metal recovery unit of claim 2 wherein said reservoir means comprises a photographic film processor means including pump means for moving liquid between said processor means and said container means.

4. The metal recovery unit of claim 1 wherein said control means is actuated to develop said first current density at said cathode in response to the operation of said processor means.

5. The metal recovery unit of claim 4 wherein said control means maintains said first current density at said cathode so long as said processor means is in operation and for a preset time period following the cecessation of operation of said processor means.

6. The metal recovery unit, as defined in claim 1, wherein said control means comprises:

transformer means having a primary winding and a secondary winding;

switching means for supplying one of at least two preselected volatages to said primary winding coil of said transformer for a predetermined time period, rectifier means for converting an AC signal at the output of said transformer means into a DC signal, which is applied to said cathode and said anode for electrolytically depositing metal on said cathode.

7. The metal recovery unit of claim 1 wherein said metal-laden liquid comprises photographic film fixer solution containing silver and said second current density at said cathode is less than that current density which results in sulfiding in the solution.

8. The metal recovery unit of claim 1 wherein said pump means associated with recirculation of said liquid through said container means operates continuously while said metal recovery unit is operable.

* * * * *